United States Patent [19]

Striebig

[11] 4,150,597

[45] Apr. 24, 1979

[54] CIRCULAR SAW FOR CUTTING PANELS

[76] Inventor: Ludwig Striebig, Grossmatte, CH-6014 Littau, Switzerland

[21] Appl. No.: 895,516

[22] Filed: Apr. 11, 1978

[51] Int. Cl.[2] ..... B27B 5/06

[52] U.S. Cl. ..... 83/471.3; 83/477.1; 83/488; 83/563

[58] Field of Search ..... 83/471.3, 471.2, 477.1, 83/482, 488, 563

[56] References Cited

U.S. PATENT DOCUMENTS 2,741,277 4/1956 Leger ..... 83/471.2

FOREIGN PATENT DOCUMENTS 1502657 10/1967 France ..... 83/488

*Primary Examiner*—J. M. Meister

*Attorney, Agent, or Firm*—Hans Berman

[57] ABSTRACT

A saw arrangement in which a panel to be cut is backed in an upright position by a frame and is supported by a lower edge rest includes a vertically extending carrier bar horizontally sweeping the working area defined by the backing frame and the edge rest, a carriage vertically movable on the carrier bar, and a sawing device movable on the carriage transversely to the working plane. Operating elements for so moving the carrier bar, the carriage, and the sawing device may be connected individually to a central drive unit by means of a single motion transmitting element and individual controls for drivingly connecting the motion transmitting element to the carrier, the carriage, and the sawing device.

9 Claims, 2 Drawing Figures

CIRCULAR SAW FOR CUTTING PANELS

Figure 1:
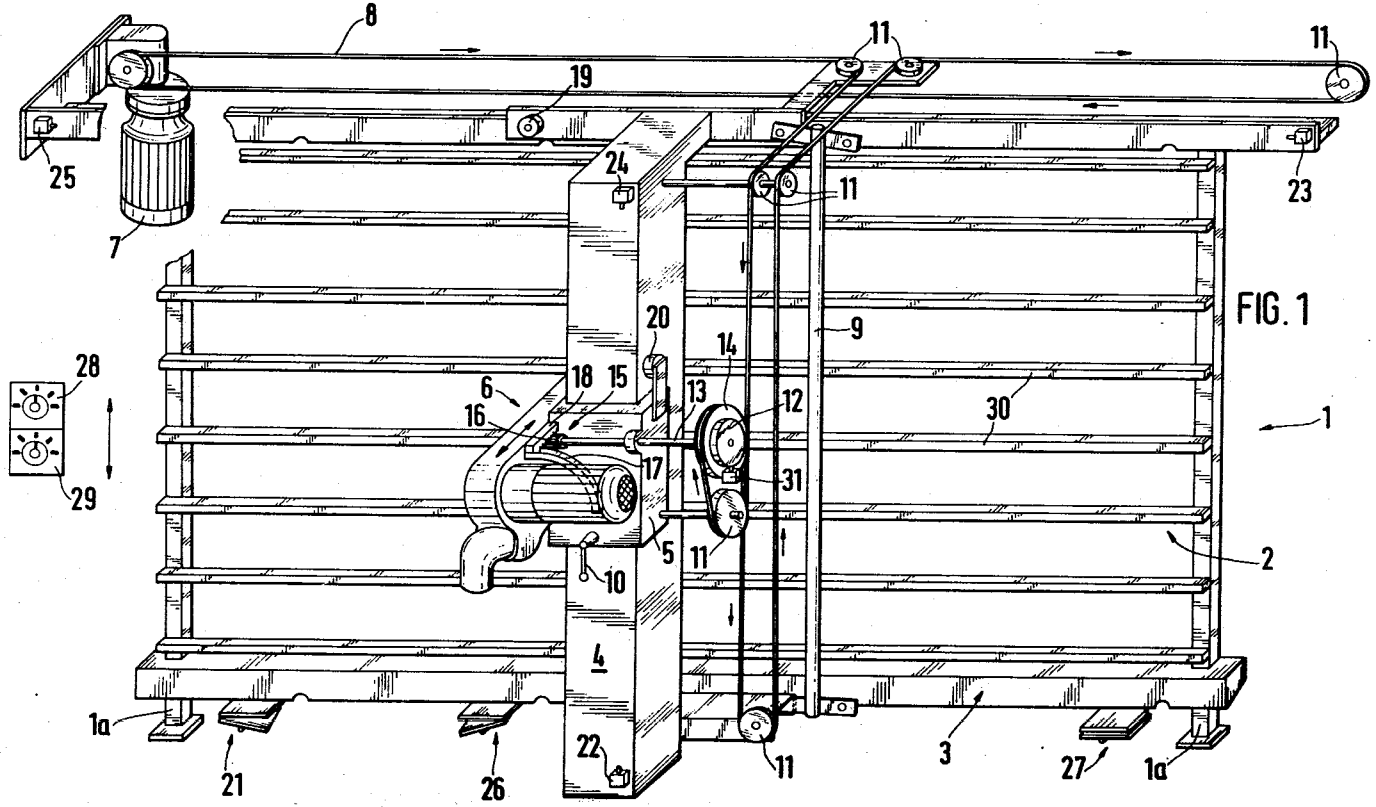

The invention relates to a circular saw for cutting panels including an approximately vertically standing frame with a backing grid as a two-dimensional support for horizontal and vertical cutting to size of panels to be set on a horizontal panel edge support, such as chipboard, plywood, plastic panels and the like, a saw carrier bar guided for horizontal movement on the frame, and a saw unit mounted on the bar for vertical movement and including a sawing device which may be displaced relative to the saw carrier bar inward and outward of the working surface defined by the backing grid.

In known circular saws of this type for cutting panels, a multiplicity of individual driving devices are provided for the displacement of the individual elements of the saw in their respective paths of movement, the driving devices mostly being operative in only one direction of movement of a saw element, thus being capable, for example, of performing either a forward feed or a return run of the saw unit. Additionally, drives of different drive types are frequently combined, such as electromotive drives with pneumatic and hydraulic drives and the like, which leads to an overall construction which is complicated and costly in its structural elements.

It has also been found disadvantageous that the control devices for operating the drive devices of the sawing elements are mostly provided on a switch casing, a so-called "control pear" which participates in the movement of the saw carrier bar so that the operating personnel must follow the sawing process for actuating the control elements and cannot occupy the working position most favorable for supplying or removing the panels and also for the operation steps themselves.

The object of the invention thus resides in providing a circular saw for cutting panels whose operating steps are capable of being performed automatically by a drive arrangement designed for the simplest possible construction, the automatic operation, however, being capable at any time of being switched to manual operation, and manual operation being capable of being performed substantially uninfluenced by the automatic drive elements present.

This object is achieved according to the invention in a circular saw for cutting panels according to the initial definition by the provision of individual driving devices respectively associated with the saw elements for the feeding movement of the saw carrier bar, the shifting of the saw unit along the carrier bar, and the displacement of the sawing device into and out of the cutting position, that all driving devices are connected with each other by a motion transmitting element capable of being operated by a central drive unit, and that control means are provided at each of the aforementioned saw elements for the selective actuation of one of the driving devices according to the working steps.

The provision of a central drive unit for driving all functional units of the panel saw by means of a motion transmitting element common to the devices permits an advantageous simplification in the design and operation of the control means for the selective switching on and off of the required working devices in accordance to the working steps because the control means need only perform switching on and off processes in view of the permanent availability of driving energy at all driving devices.

Additionally, a switching from automatic drive to manual operation merely requires that the central drive unit be switched on or off which is relevant from considerations of safety because it is known to be important in dangerous situations to switch off all connected functional groups jointly if possible. Because of the known difficulties encountered in uncoupling automatic drives from the saw elements of conventional panel saws, only such panel saws were built which were equipped either with automatic drive or were capable of being operated manually only. The structurally simple design of the automatic drive provided according to the invention permits the one necessary motion transmitting element to be guided and controlled at low friction so that this motion transmitting element presents practically no disadvantageous resistance to manual operation when the automatic drive is switched off.

In operating a panel cutting circular saw, the cutting-to-size operation is generally planned in such a manner that at first, for example, the necessary horizontal cuts are performed, and the saw unit thereafter is pivoted into a vertical position of its saw blade for cutting the ultimate lengths of work pieces. Contrary to the aforementioned functional steps of the saw elements, the pivoting of the saw blade from a horizontal position into a vertical position and vice versa is an operating step which is performed manually even when an automatic drive is available. In the circular saw for cutting panels according to the invention, arresting mechanisms are provided between the frame and the saw carrier bar, and between the latter and the saw unit which are operable independently of each other for exact positioning of the relatively displaceable saw elements for horizontal or vertical cutting.

According to a preferred embodiment, the central drive unit is arranged on the frame outside the working area that may be swept by the afore-mentioned saw elements, and the motion transmitting element consists of an endless drive member which is guided to the driving devices by way of several deflecting devices suitably aligned with the saw elements. The endless drive member needs to be trained only over a few deflecting devices for favoring operation at low friction if the central drive unit is arranged at a corner section of the frame, and the endless drive member extending from this drive unit spans at least the entire horizontal length of the frame and is guided at the instantaneous location of the saw carrier bar on the frame along the saw carrier bar and at least over the entire vertical shifting path of the saw unit, and sequentially engages the driving device for forward feeding of the saw carrier bar, the driving device for shifting the saw unit, and the additional driving device for displacement of the sawing device.

The endless drive member may be constituted by a driving cable, the deflecting devices being rotatably mounted guide pulleys. However, other drive members such as flat, cog or V-belt or link chain drives may be employed.

A preferred embodiment of a driving device for displacement of the sawing device includes, as a switching mechanism, a clutch provided between a shaft rotatably supported on the saw unit and a drive wheel engaged by the drive member, the shaft being connected with a positioning drive for shifting the sawing device in response to shaft rotation. Such a positioning drive may be a pinion fastened on the shaft with which a rack mounted on the saw unit cooperates, the connection between the rack and the saw unit which permits pivoting movement of the saw unit through at least 90° for displacement from the vertical cutting position into a horizontal cutting position and vice versa, being provided by a quarter-circle segment which maintains engagement with ract in any angular position within the indicated range. The positioning drive could also be designed as a threaded spindle cooperating with a nut or as a worm drive.

A pole changing electric motor having, for example, four speeds, may be used as the central drive unit, and suitable preselector switches may be connected with such an electric motor which permit adjustable of the forward and backward rotation of the drive unit at different speeds.

Figure 2:
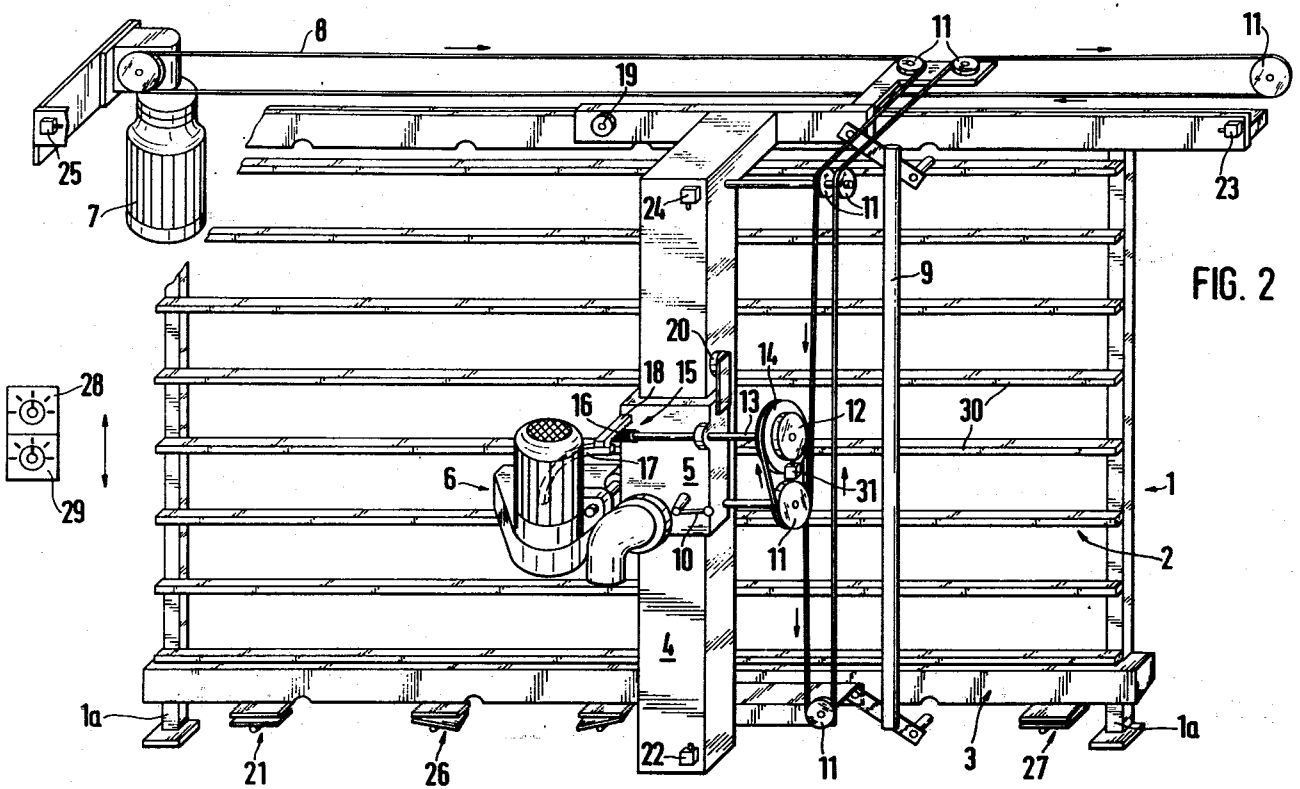

An embodiment of the invention is being described below in more detail by reference to the drawings wherein:

FIG. 1 is a perspection front view of a circular saw for cutting panels embodying the features of the invention, a sawing device being in an angular position for performing vertical cuts; and FIG. 2 is a front view analogous to that of FIG. 1 with a sawing device in an angular position for performing horizontal cuts.

The circular saw for cutting panels shown figures in the drawing figures has a frame 1 which rests in approximately vertical, standing position on feet 1*a* and includes a supporting grid 2 as a two-dimensional backing for a panel to be cut and not illustrated. A horizontal panel edge rest 3 is located on the lower section of the frame 1, and panels to be cut to size horizontally and vertically may be deposited on the same. A saw carrier bar 4 is supported for horizontal movement on the also horizontally extending lower and upper sections of the frame 1 by means of suitable guides. This saw carrier bar 4 guides a vertically shiftable carriage 5 whose left side, as viewed in the drawing figures, carrier a sawing device 6 capable of being displaced relative to the saw carrier bar 4 and to the carriage 5 into and out of a work surface defined by the backing grid.

Several predetermined positions are prescribed on the frame 1 or the backing grid for performing vertical cuts, and a control rod 9 constituting an arresting device may be locked in these positions. When horizontal cuts are to be carried out, the sawing device 6 must be turned into its angular position relative to the carriage 5 which is illustrated in FIG. 2. For this purpose, an arresting device between the carriage 5 and the saw carrier bar 4 and constituted by a blocking screw 10 can be released and clamped fast again after tilting of the sawing device through 90°. After a subsequent unlocking of the control rod 9, the saw carrier bar 4 may be shifted together with the horizontally positioned sawing device 6 along the frame 1. If the saw blade of the sawing device 6 would impinge on one of the backing grid rails 30 which constitute the backing grid 2, a non-illustrated withdrawing mechanism provided on the rear side of the saw unit, as viewed in the drawing may become operative for moving the affected backing grid rail 30 in the plane of the backing grid parallel to the other rails. This movement takes place preferably simultaneously with the displacement of the sawing device 6 inward of the working surface defined by the backing grid 2 which displacement is also referred to as "dipping." Correspondingly, this withdrawing mechanism lets the affected backing grid rail 30 return into its starting position during an outward displacement of the sawing device, the so-called "emerging step."

A central drive unit 7 is arranged in the terminal, left, upper corner section of the frame 1, and its driven pulley is located outside the working area on the frame 1 capable of being swept by the saw elements 4, 5, and 6, and is associated with a motion transmitting element 8, an endless drive cable which extends over the entire horizontal, longitudinal side of the frame 1 and is trained over a reversing pulley 11 at the end of the frame 1 opposite the drive unit 7. Additionally the upper strand of the motion transmitting element 8, as viewed in the drawing figures, is trained in loop adjacent the saw carrier bar 4 over the entire vertical path of the carriage 5 by several additional pulleys 11. Driving devices respectively associated with the saw elements 4, 5, and 6 are connected with each other by the cable 8 in such a manner that the saw carrier bar 4 may be moved over the entire length of the frame 1, the carriage 5 may be displaced along the saw carrier bar 4, and the sawing device 6 transversely to the carriage 5 during operation of the central drive unit 7. It is necessary, however, to coordinate the afore-described movements for performing sawing operations, and control mechanisms for selectively actuating their driving devices in response to the working steps are provided on each of the afore-mentioned saw elements 4, 5, and 6. The two driving devices for the movement of the saw carrier bar 4 and the vertical shifting of the carriage 5 are not shown in the drawing. They are located in the area spanned by the cable 8.

The driving device for displacing the sawing device 6 includes a clutch 12 operatively interposed between one end of a shaft 13 rotatably mounted on the carriage 5 and a drive wheel 14 engaged by the cable 8 after deflection by a pulley 11. A positioning drive 15 is provided at the other end of the shaft 13 and is constituted by a pinion 16 and a rack 18 engaging the pinion. The rack 18 is connected with the sawing device 6 in such a manner that the latter may be shifted by rotation of the shaft 13 so that the saw blade of the sawing device 6 dips into the working surface defined by the backing grid 2, or emerges from the working surface. To permit the positioning drive 15 to be effective independently from the vertical or horizontal angular position of the sawing device 6, a quarter-circle segment 17 is provided in the connecting section between the rack 18 and the sawing device 6, is taken along by the sawing device 6 during the tilting movement of the saw blade into the horizontal position shown in FIG. 2, and simultaneously maintains engagement with the rack 18.

The non-illustrated driving device for the saw carrier bar transport has, as a control mechanism, a brake 19 engaging the frame 1, and the carriage 5 may be fixed on the saw carrier bar 4 by an additional brake 20.

When the panel saw is to be operated for performing vertical cuts, the saw carrier bar 4 is first shifted into the necessary cutting position on the frame 1 and is blocked there by the arresting mechanism 9. When the central drive unit 7 is energized thereafter by means of a switch 21 at the underside of the frame 1, the cable 8 no longer can shift the saw carrier bar 4 because of its blockage. The sawing device 6 and its saw blade are still located outside of the working surface defined by the backing grid 2, that is, in their emerged position. Because the dipping and emerging of the sawing device 6 requires a greater expenditure of force than the operation of the driving device for shifting the carriage 5, it is necessary, because of the positive coupling with this driving device to block the carriage 5 during the dipping and emerging movement of the sawing device by means of the brake 20. The brake 20 and the clutch 12 between the shaft 13 and the drive wheel 14 are switched on simultaneously with the actuation of the switch 21 so that the shaft 13 turns and moves the positioning drive 15. At the end of the dipping process, the brake 20 is released by a switch 31 provided at the clutch so that the carriage 5 shifts along the saw carrier bar 4 under the action of its driving device. If the carriage 5 moves downward, as viewed in FIG. 1, it abuts on a motion reversing switch 22 at the end of its path of movement which switch, when actuated, reverses the direction of movement of the central drive unit 7. The brake 20 is simultaneously operated by the switch 31 so that an emerging movement of the sawing device 6 is carried out by the positioning drive 15 in response to the reversed driving force at the cable 8. At the end of this movement, the brake 20 is released again by the switch 31 so that the carriage 5 is shifted upward on the saw carrier bar 4. A shut-off switch 24 is provided at the upper, terminal position of the carriage 5, a deenergizes the drive unit 7 and releases the clutch 12 when actuated. Thereafter, the saw elements 4, 5, and 6 may be operated manually while the drive unit 7 is deenergized and the clutch 12 is released.

For horizontal tilting movement of the sawing device 6 for performing horizontal cuts, the control rod 9 is released from the frame 1 so that the saw carrier bar 4 is enabled to be shifted along the frame. Additionally, the carriage 5 is blocked by the blocking screw 10 on the saw carrier bar 4 so that a fixed horizontal spacing of the horizontal panel edge rest 3 from the saw blade of the sawing device 6 is established. Because of the unblocking of the control rod 9 from the frame 1, the driving device provided for the saw carrier bar is again enabled to shift the saw carrier bar 4 when the drive unit 7 is energized. The dipping and emerging steps of the sawing device 6 occur in analogy to the described performance of vertical cuts, the brake 19 between the saw carrier bar 4 and the frame 1 being actuated during the dipping and emerging steps by the switch 31 instead of the brake 20 between the carriage 5 and the saw carrier bar 4. A further motion reversing switch 23 is located at the right end of the path of movement of the saw carrier bar 4, as viewed in FIG. 2, and its function corresponds to that of the switch 22. An additional shut-off switch 25 is located at the left end of the horizontal path of movement, and its function corresponds to that of the switch 24.

All switches 21, 26, and 27 mounted on the frame may be provided with actuating elements permitting operation from any desired position at the frame 1. The safety switch 27 may be designed and arranged in such a manner that a panel section dropping from the frame, for example, triggers the switch.

Two pre-selector switches 28 and 29 are shown schematically to the left next to the drawing figures, and different drive speeds in the two directions of movement of the drive unit 7 may be set thereby independently of each other. The drive unit, which may be a pole-changing electric motor having four speeds, for example, may be controlled in such a manner that a predetermined dipping or feeding speed for the sawing device 6, the carriage 5 and the saw carrier bar 4 respectively is selected, for example, by means of the preselector switch 28, and a driving speed in the opposite direction of rotation, independent from the first selected speed is determined by means of the pre-selector switch 29 for the emerging and return movements of the aforementioned saw elements 4, 5, and 6. Motors having multiple-speed transmissions or stepless transmission, also air or oil engines may be employed in the drive units 7.

When the central drive unit 7 stands still and the plate saw is to be operated by hand, the cable 8 which connects the several driving devices does not offer significant resistance because, for example, during manual vertical cutting in a fixed position of the saw carrier bar 4 only one deflecting element 11 at the 5 and the idling, because uncoupled drive wheel 14 must be turned while the motion transmitting cable 8 stands still. Correspondingly, only the six deflector elements 11 supported on the saw carrier bar 4 need to be turned during performance of a horizontal cut together with the drive wheel 14, also uncoupled.

Because only portions of the motion transmitting element 8 are needed for driving the individual saw elements 4, 5, and 6, the motion transmitting element need not be an endless cable. Both ends of the motion transmitting element may be fastened, for example, on the drive drum, a clutch being arranged between each driving device and the motion transmitting element.

I claim:

1. In an arrangement for cutting panels including a vertically extending frame for backing a panel to be cut, a horizontally extending edge rest for supporting the lower edge of a backed panel, said frame and rest defining a vertically extending work area, a vertically extending carrier member guided on said frame for horizontal movement along said area between a plurality of horizontally spaced positions in a predetermined range, a carriage mounted on the carrier member for shifting movement between a plurality of vertically spaced positions in a predetermined range, a sawing unit including a saw blade and mounted on said carriage for movement between an operative position and a retracted position, said saw blade in said positions of the unit being located in said work area and being retracted from said area respectively, and drive means on said carriage for moving said sawing unit between said positions thereof, the improvement which comprises:

(a) a drive unit mounted in a fixed position relative to said frame; and (b) motion transmitting means for transmitting motion from said drive unit to said drive means in each of said positions of said carrier member and of said carriage, said motion transmitting means including an elongated motion transmitting element trained from said drive unit to said drive means in a path extending horizontally along said frame over the entire range of said horizontal movement and vertically along said carrier member along the entire range of said shifting movement.

2. In an arrangement as set forth in claim 1, said motion transmitting element including an endless cable, said frame and said carrier member supporting a plurality of deflecting elements defining said path, said cable being trained over said deflecting elements.

3. In an arrangement as set forth in claim 2, said frame being rectangular, said drive unit being mounted on one of the four corners of said frame, said path extending from said drive unit over substantially the entire horizontal dimension of said frame, thereafter horizontally back to one vertical end of said carrier member, along said carrier member to said carriage and further to the other vertical end of said carrier member, and thereafter back to said drive unit.

4. In an arrangement as set forth in claim 1, said drive means including a drive shaft rotatable on said carriage, a wheel, a clutch operatively interposed between said drive shaft and said wheel, said motion transmitting element being trained over said wheel, and control means for engaging and disengaging said clutch.

5. In an arrangement as set forth in claim 4, said drive means further including a pinion on said shaft, and rack means meshing with said pinion and operatively connected to said sawing unit for moving said sawing unit between said positions thereof in response to rotation of said shaft.

6. In an arrangement as set forth in claim 4, wherein said clutch is electrically operated, and said control means include switch means responsive to movement of said carrier member to one end of said range of horizontal movement for controlling said clutch.

7. In an arrangement as set forth in claim 4, wherein said clutch is electrically operated, and said control means include switch means responsive to movement of said carriage to one end of said range of shifting movement for controlling said clutch.

8. In an arrangement as set forth in claim 1, shut-off means for shutting off said drive unit in all said positions of said carrier member and of said carriage.

9. In an arrangement as set forth in claim 1, said drive unit including an electric motor.

* * * * *